US005770549A

United States Patent [19]

Gross

[11] Patent Number: 5,770,549

[45] Date of Patent: Jun. 23, 1998

[54] SURFACTANT BLEND FOR NON-SOLVENT HARD SURFACE CLEANING

[75] Inventor: Stephen F. Gross, Souderton, Pa.

[73] Assignee: Henkel Corporation, Plymouth Meeting, Pa.

[21] Appl. No.: 617,449

[22] Filed: Mar. 18, 1996

[51] Int. Cl.[6] ..... C11D 1/52; C11D 1/72

[52] U.S. Cl. ..... 510/238; 510/109; 510/421; 510/470

[58] Field of Search ..... 510/238, 501, 510/502, 470, 109, 421

[56] References Cited

U.S. PATENT DOCUMENTS

| | | | |
|---|---|---|---|
| 1,985,424 | 3/1934 | Piggott | 260/124 |
| 2,965,576 | 12/1960 | Wilson | 252/137 |
| 3,663,445 | 5/1972 | Augustin et al. | 252/117 |
| 4,151,127 | 4/1979 | Perner et al. | 252/542 |
| 4,321,166 | 3/1982 | McGrady | 252/542 |
| 4,483,780 | 11/1984 | Llenado | 252/135 |
| 4,627,931 | 12/1986 | Malik | 510/470 |
| 4,784,798 | 11/1988 | Geke et al. | 252/544 |
| 4,915,864 | 4/1990 | Kita et al. | 252/117 |
| 5,194,639 | 3/1993 | Connor et al. | 554/66 |
| 5,266,690 | 11/1993 | McCurry, Jr. et al. | 536/18.6 |
| 5,286,402 | 2/1994 | Geke et al. | 252/121 |
| 5,334,764 | 8/1994 | Scheibel et al. | 564/487 |
| 5,395,543 | 3/1995 | Johansson et al. | 510/470 |
| 5,527,362 | 6/1996 | Cole et al. | 510/470 |
| 5,545,354 | 8/1996 | Ofosu-Asante | 510/502 |

FOREIGN PATENT DOCUMENTS

| | | |
|---|---|---|
| 1537265 | 7/1968 | France . |
| 2505252 | 8/1975 | Germany . |
| 3530623 | 8/1985 | Germany . |
| 1321513 | 6/1973 | United Kingdom . |

OTHER PUBLICATIONS

Kirk–Othmer, Encyclopedia of Chemical Technology, vol. 21; pp. 162–164 date unknown.

*Primary Examiner*—Margaret Medley
*Attorney, Agent, or Firm*—Ernest G. Szoke; Wayne C. Jaeschke; Steven J. Trzaska

[57] ABSTRACT

A cleaning composition containing: (a) from about 3 to about 67% by weight of a sugar surfactant; and (b) from about 1 to about 3% by weight of a $C_6$–$C_{12}$ linear alcohol ethoxylate, all weights being based on the weight of the concentrate.

2 Claims, No Drawings

SURFACTANT BLEND FOR NON-SOLVENT HARD SURFACE CLEANING

FIELD OF THE INVENTION

The present invention generally relates to a novel hard surface cleaner. More particularly, the present invention relates to a non-solvent degreasing composition use for removing oils and grease from hard surfaces.

BACKGROUND OF THE INVENTION

U.S. Pat. No. 3,663,445 relates to liquid, storable concentrates consisting of 6 to 45% by weight of a nonionic surfactant, for example a fatty alcohol ethoxylate, 4 to 33% by weight of an ethanolamine salt of a fatty acid, 2 to 90% by weight of an ethanolamine and 0 to 50% by weight water and to cleaning and degreasing preparations, more particularly for metallic surfaces, which are obtained from the concentrates by dilution with water.

AT-PS 308 936 relates to liquid, storable concentrates consisting of at least 5% by weight of a nonionic surfactant, for example a fatty alcohol ethoxylate, at least 3% by weight of a saturated or unsaturated fatty acid containing 8 to 22 carbon atoms in the molecule, at least 4.5% by weight of one or more alkanolamines and typical additives, such as complexing agents, and water and to cleaning and degreasing preparations obtainable from the concentrates by dilution with water.

GB-PS 1,321,513 relates to a process for cleaning metal surfaces using two cleaning baths applied one after the other, namely a precleaning bath and a degreasing bath. The precleaning bath consists of at least 5% by weight of a nonionic surfactant containing 3 to 5 mol ethylene oxide, at least 3% by weight of a fatty acid and/or an alkyl polyethylene oxide carboxylic acid, at least 1.5% by weight of an alkanolamine and/or oxazine and, for the rest, of water. The degreasing bath consists of an inorganic or organic alkaline substance, for example potassium hydroxide, potassium carbonate, potassium orthophosphate, potassium pyrophosphate, potassium borate, alkanolamine, preferably mono-, di- or triethanolamine, morpholine, and a complexing agent, a low-foaming surfactant, for example a condensation product of fatty acids with 3 to 5 mol ethylene oxide, and other additives and, for the rest, of water.

AT-PS 299 421 relates to a water-based liquid detergent for dishwashing machines containing 2 to 6% by weight of a nonionic surfactant, 15 to 25% by weight of an organic sequestrant, 7 to 15% by weight of a hydrotropic substance, 3 to 15% by weight of an ethanolamine and 0.1 to 0.6% of a corrosion inhibitor.

DE-OS 25 05 252 relates to a process for the industrial cleaning and degreasing of articles, more particularly of metals, by treatment of the articles with a solventless aqueous solution containing an organic sequestrant and a hydrotropic substance, characterized in that the aqueous solution used contains 0.1 to 20% by weight of an organic hydrotropic electrolyte in the form of benzenesulfonates, lower alkylbenzenesulfonates, di-(lower alkyl)-benzenesulfonates or mixtures thereof and 0.1 to 25% by weight of an organic sequestrant in the form of aminopolycarboxylic acids or aminopolyphosphonic acids or salts or mixtures thereof, the ratio by weight of the electrolyte to the sequestrant being 2:1 to 1:3 and the pH value of the solution being in the range from 9 to 13.

U.S. Pat. No. 4,321,166 relates to liquid cleaning preparations containing 20 to 70% by weight of a surfactant, for example a fatty alcohol ethoxylate, 0.85 to 2% by weight of a corrosion inhibitor system consisting essentially of a mixture of an oligomeric olefinic fatty acid and an aromatic triazole and 1 to 75% by weight water.

DE-OS 35 30 623 relates to emulsifying cleaning preparations with a surface moisturizing effect which contain builders/complexing agents in a quantity of 0.5 to 10% by weight, one or more alkanolamine(s) in a quantity of 20 to 60% by weight, one or more nonionic surfactant(s) in a quantity of 1 to 15% by weight and, for the rest, water. These cleaning preparations and corresponding cleaning compositions are suitable for the cleaning and degreasing of painted and unpainted vehicle surfaces, engines, floors and walls of workshops, etc., even at room temperature, with demulsification of the oily or greasy soil removed.

However, the emulsifying effect of these known cleaning preparations does not satisfy present-day requirements. In other words, their emulsification of the oil-containing soil removed and the resulting, subsequent separation of oil are not sufficient to reduce the residual oil contents in the wastewater to the low levels required today.

By contrast, the problem addressed by the present invention was to provide a degreasing composition for the cleaning of hard surfaces soiled with oil (whether polar or nonpolar) which would have a better emulsifying effect and also a better cleaning effect than known cleaning preparations. In addition, the demulsifying effect of the cleaning preparations would result in improved oil removal and hence in lower residual oil contents in the wastewater.

Moreover, known degreasing compositions typically employ solvents, harmful to the environment, which act as carriers for the surfactants contained therein. The surfactant blend of the present invention, on the other hand, does not require the use of a solvent, thereby imparting a significantly enhanced ecotoxicological profile onto its degreasing compositions.

SUMMARY OF THE INVENTION

The present invention is thus directed to a degreasing composition and process for removing oils and grease from hard surfaces. The degreasing composition contains a mixture of (a) from about 3 to about 67% by weight of a sugar surfactant selected from the group consisting of alkyl polyglycosides and polyhydroxy fatty acid amides, (b) from about 1 to about 33% by weight of a $C_6$–$C_{12}$ linear alcohol ethoxylate, and (c) up to about 96% by weight of water, all weights being based on the weight of the composition.

There is also provided a process for removing oils and grease from hard surfaces involving contacting the hard surfaces with the above-disclosed degreasing composition.

DESCRIPTION OF THE INVENTION

Other than in the operating examples, or where otherwise indicated, all numbers expressing quantities of ingredients or reaction conditions used herein are to be understood as being modified in all instances by the term "about".

The sugar surfactants which may be employed in the degreasing composition of the present invention include alkyl polyglycosides and polyhydroxy fatty acid amides. The alkyl polyglycosides which can be used in the compositions according to the invention have the formula I $$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. APG® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.48.
3. GLUCOPON® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.5.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The polyhydroxy fatty acid amides which can be used in the compositions and processes according to the invention are compounds of the formula II:

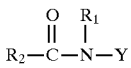

(II)

wherein: $R_1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Y is a polyhydroxyhydrocarbyl moiety having a linear hydrocarbyl chain with at least 3 hydroxyls directly connected to the chain, or an alkoxylated derivative (preferably ethoxylated or propoxylated) thereof. Y preferably will be derived from a reducing sugar in a reductive amination reaction; more preferably Y is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Y. It should be understood that it is by no means intended to exclude other suitable raw materials. Y preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or poly- saccharide, and alkoxylated derivatives thereof. Most preferred are glycityls wherein n is 4, particularly $—CH_2—(CHOH)_4—CH_2OH$. Compounds of the formula I are also known as glucamides. Therefore, when, for example, $R_1$ is methyl, $R_2$ dodecyl; and Y is $—CH_2—(CHOH)_4—CH_2OH$, the compound in question is referred to as dodecyl N-methylglucamide.

Methods for making polyhydroxy fatty acid amides are known in the art. In general, polyhydroxy fatty acid amides can be made by reductively aminating a reducing sugar reacting with an alkyl amine to form a corresponding N-alkyl polyhydroxyamine and then reacting the N-alkyl polyhydroxyamine with a fatty aliphatic ester or triglyceride to form the N-alkyl, polyhydroxy fatty acid amide. Processes for making polyhydroxy fatty acid amides are disclosed in U.S. Pat. Nos. 1,985,424; 2,965,576; 5,194,639; and 5,334,764 the entire contents of each of which is incorporated herein by reference.

In a particularly preferred embodiment of the present invention the sugar surfactant employed is an alkyl polyglycoside of formula I wherein $R_1$ is an alkyl group having from 8 to 16 carbon atoms, b is zero, and a is a number having a value of 1.48.

The linear alcohol ethoxylates which may be employed in the present invention are generally the $C_6$–$C_{12}$ straight-chain alcohols which are ethoxylated with from about 3 to about 6 moles of ethylene oxide. Their derivation is well known in the art.

In a particularly preferred embodiment of the present invention, the linear alcohol ethoxylate is preferably a straight-chain $C_8$–$C_{10}$ alcohol alkoxylated with 4.5 moles of ethylene oxide.

The cleaning composition is preferably formed by mixing from about 3 to about 67% by weight, and most preferably from about 5 to about 30% by weight of a sugar surfactant, with from about 1 to about 33% by weight, and most preferably from about 2 to about 10% by weight of a linear alcohol ethoxylate, all weights being based on the composition. The sugar surfactant thus employed is preferably an alkyl polyglycoside of formula I wherein $R_1$ is a $C_8$–$C_{16}$ alkyl group, b is zero, and a is 1.48. The linear alcohol ethoxylate is preferably a $C_8$–$C_{10}$ linear alcohol alkoxylated with about 4.5 moles of ethylene oxide.

It should be noted that the above-disclosed cleaning composition may, if desired, be further diluted with up to about 96% by weight of water, based on the weight of the cleaning composition. However, regardless of the amount of water to dilute the cleaning composition of the invention, the critical formulation parameter is that the cleaning composition contain the sugar surfactant and linear alcohol ethoxylate in a percent active ratio of from 3:1 to 2:1, respectively.

The cleaning composition may also include builders and auxilliaries typically employed in such cleaning preparations. Examples of suitable builders which may be used include, but are not limited to, TSPP, STPP, silicates and citrates. Similarly, examples of suitable auxilliaries which may be used include, but are not limited to, sodium hydroxide, potassium hydroxide, TEA and MEA.

The advantages associated with the use of cleaning compositions according to the present invention are numerous, with the most obvious being that it is a non-butyl cleaner. For example, the hydrotrope properties of the sugar surfactant component enables more builders and surfactants to be incorporated into the composition. Also, the present composition possesses enhanced emulsification properties with respect to both polar and non-polar oils, thereby imparting superior grease cutting properties to the composition, at reduced formulation costs.

The present invention will be better understood from the examples which follow, all of which are intended to be illustrative only and not meant to unduly limit the scope of the invention. Unless otherwise indicated, percentages are on a weight-by-weight basis.

EXAMPLE I

A cleaning composition in accordance with the present invention was prepared having the following formulation.

| Component | %/wt. |
|---|---|
| (a) GLUCOPON ® 425-N (50% active) | 4.0 |
| (b) ALFONIC ® 810-4.5 (100% active) | 1.2 |
| (c) water | 94.8 |
| | 100.0 |

*GLUCOPON ® 425-N is an alkyl polyglycoside having a monovalent organic radical with from 8 to 16 carbon atoms, and an average degree of polymerization of 1.48, commercially available from Henkel Corp., Ambler, PA.

*ALFONIC ® 810-4.5 is $C_{8-10}$ linear alcohol alkoxylated with 4.5 moles of ethylene oxide, commerically available from Vista Chemical.

COMPARATIVE EXAMPLE I

| Component | %/wt. |
|---|---|
| (a) nonylphenol(9)EO (100% active) | 2.0 |
| (b) amine oxide[1] (50% active) | 1.0 |
| (c) quaternary[2] ammonium (75% active) | 1.9 |
| (d) water | 96.0 |
| | 100 |

[1] = bishydroxyethylisodecyloxypropyl amine oxide
[2] = isodecyloxypropyl dihydroxyethyl methyl ammonium chloride The cleaning compositions of Example I and Comparative Example I were then tested to determine their cleaning efficiency per the following test method. A test soil consisting of kerosene, mineral oil, motor oil, a 5:1 mixture of mineral oil:carbon black, and band black clay was applied onto the rough side of two 3"×3" vinyl tiles in equal amounts of 0.5ml. The tiles were then dried for 20 minutes at room temperature, for 20 minutes at 100° C., and then for an additional 20 minutes at room temperature. The two tiles were then placed into a Gardner Apparatus wash tray, with the grain parallel to the direction of sponge travel. The two cleaning compositions were then individually added to the separate trays in amount of 200 ml and allowed to stand for 1 minute. The tiles were then scrubbed with a synthetic sponge for 40 cycles, rotating the tiles 90° after 20 cycles. The tiles were then rinsed with deionized water and dried at room temperature for about 1 hour. The reflectance of the washed tiles was measured and cleaning efficiency determined using the calculation % soil removal=$(R_w-R_s/R_u-R_s)\times 100$, wherein $R_w$ is reflectance of washed tile, $R_s$ is reflectance of soiled tile, and $R_u$ is reflectance of unsoiled tile. The results are found in Table I below.

| | % SOIL REMOVAL |
|---|---|
| EXAMPLE I | 45.48 |
| COMPARATIVE EXAMPLE I | 35.40 |

As can be seen from the data obtained, a cleaning composition utilizing the cleaning concentrate of the present invention is significantly more effective at removing oils and greases from hard surfaces than other known concentrates.

What is claimed is:

1. A process for removing oils and grease from a hard surface comprising contacting the hard surface with a cleaning composition comprising:

(a) from about 3 to about 67% by weight of an alkyl polyglycoside corresponding to formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6;

(b) from about 1 to about 33% by weight of a $C_6$–$C_{12}$ linear alcohol ethoxylate having from about 3 to about 6 moles of ethylene oxide; wherein (a) and (b) are present in the said composition in a percent active ratio of from about 3:1 to about 2:1 and (c) up to about 96% by weight water, all weights being based on the weight of the composition, with the proviso that the said cleaning composition is free of solvents that are harmful to the environments.

2. The process of claim 1 wherein the linear alcohol ethoxylate is a $C_8$–$C_{10}$ linear alcohol ethoxylated with 4.5 moles of ethylene oxide.

* * * * *